US005213918A

United States Patent [19]

Donofrio

[11] Patent Number: 5,213,918

[45] Date of Patent: May 25, 1993

[54] COLOR REFERENCE CRT AND METHOD OF MAKING

[75] Inventor: Robert L. Donofrio, Saline, Mich.

[73] Assignee: North American Philips Corporation, New York, N.Y.

[21] Appl. No.: 849,247

[22] Filed: Mar. 11, 1992

Related U.S. Application Data

[62] Division of Ser. No. 626,912, Dec. 12, 1990, Pat. No. 5,122,708.

[51] Int. Cl.[5] ..... G03C 5/00

[52] U.S. Cl. ..... 430/23; 430/25; 430/27; 430/29

[58] Field of Search ..... 430/23, 25, 27, 29

[56] References Cited

U.S. PATENT DOCUMENTS 4,607,188 8/1986 Brennesholtz ..... 313/461

*Primary Examiner*—Marion E. McCamish
*Assistant Examiner*—S. Rosasco
*Attorney, Agent, or Firm*—Norman N. Spain

[57] ABSTRACT

A color reference CRT of the type employing a screen of a pattern of individual phosphor elements of different color components, is produced by adjusting the screen weights of the different color components to achieve the desired reference color when the screen is scanned by an electron beam of predetermined beam current and anode potential.

6 Claims, 5 Drawing Sheets

COLOR REFERENCE CRT AND METHOD OF MAKING

This is a division of application Ser. No. 07/626,912, filed on Dec. 12, 1990, now U.S. Pat. No. 5,122,708.

BACKGROUND OF THE INVENTION

This invention relates to a cathode ray tube (CRT) for use as a color reference, and more particularly relates to such a tube in which the reference color is produced by the combined output of individual phosphor elements having different component colors. The invention also relates to a method for producing such a tube.

In U.S. Pat. No. 4,607,188, a color reference CRT is described in which the reference color is produced by the combined output of individual phosphor elements having different component colors, e.g., interlaced fields of the component colors formed by a pattern of repeating vertical stripes of red, green and blue emitting phosphors.

The tube is similar in construction to the standard color CRT used in color TV, except that it lacks a color selection electrode, and in operation the screen is scanned with one or more electron beams of fixed voltage and current, so that the output is observed as a single, invariant color, which is the result of the eye integrating the separate luminous outputs of the interlaced fields of the component colors.

In such a tube, a color reference having a desired color temperature is obtained by the appropriate selection of the component colors and the control of their luminous outputs by adjusting the relative sizes of the individual phosphor elements of the component color fields. As described in the patent, the latter adjustment was achieved by varying the exposure dosages (combination of time and intensity) used in the standard photolithographic process to produce the component color fields for color TV tubes.

While a main advantage of this method is that it can be carried out on a standard manufacturing line for color TV tubes using the standard color selection electrode as the exposure mask, an attendant drawback is that the size of the apertures in the color selection electrode varies from center to edge, and the responses of the component color fields to the exposures varies with both the aperture size and the component color.

Consequently, it has been observed that the color varies from center to edge of the screen, and that consequently only about a 4 inch square area in the center of the screen is actually useable as the color reference.

OBJECTS AND SUMMARY OF THE INVENTION

Accordingly, it is an object of the invention to provide a color reference CRT employing a pattern of individual phosphor elements of different component colors, which CRT does not rely on differences in the sizes of the phosphor elements for adjustment of the luminous outputs of the component color fields.

It is another object of the invention to provide a method for producing such a color reference CRT which uses the standard photolithographic techniques for producing color CRTs for color TV.

According to the invention, a color reference CRT employing a pattern of individual phosphor elements of different color components is characterized in that the relative screen weights of the different color elements are predetermined to result in a desired reference color when the screen is scanned by an electron beam of predetermined beam current and anode voltage.

As used herein, the term "screen weight" means the weight of phosphor per unit area of the screen.

According to one embodiment of the invention, the sizes of the individual phosphor elements of the component color fields are the same. According to another embodiment, the sizes of these individual elements all vary by substantially the same amount from the center to the edges of the screen, regardless of their color. Thus, the reference color is substantially invariant from the center to the edges of the screen, and substantially the entire screen area is useable as the color reference.

According to another aspect of the invention, a method is provided for controlling the luminous outputs of the component color fields, by changing the screen weights of the phosphors from one component color field to another.

According to one embodiment of the method, the screen weights ar changed by changing the rate at which the phosphor is dispensed onto the display window of the CRT during a fixed period of the manufacturing process. This method is particularly suitable for use in the so-called dusting technique, in which dry phosphor powder is dispensed onto the window by means of an auger turning at a constant speed.

According to another embodiment of the method, the screen weights are changed by changing a predetermined amount of the phosphor which is dispensed onto the window more or less instantaneously. This method is particularly suitable for use in the so-called slurry technique, in which a slurry of phosphor powder dispersed in a liquid carrier is dispensed onto the window.

Such a color reference CRT in accordance with the invention exhibits sufficient uniformity of output that substantially the entire screen area is useable as the color reference.

DESCRIPTION OF THE PREFERRED EMBODIMENT

Color CRTs for color television produce an image display on a cathodoluminescent screen composed of a repetitive array of red, blue and green phosphor elements, by scanning the array with three electron beams from an electron gun in the neck of the CRT, one beam for each of the primary (red, blue and green) colors. The beams emanate from separate gun apertures, converge as they approach the screen, pass through an aperture mask positioned a short distance behind the screen, and then diverge slightly to land on the appropriate phosphor element. At a comfortable viewing distance, the human eye cannot resolve the individual red, blue and green elements in the screen, but rather integrates these primary colors to perceive additional colors produced by the primary colors.

Early CRTs for color television had screens composed of arrays of phosphor dots, but dot screens have been largely replaced by screens composed of arrays of vertically oriented phosphor stripes. As is known, such screens are primarily advantageous in alleviating the requirement for accurate registration between the mask and screen in the vertical direction.

The masks for these striped screens are composed of vertically oriented columns of slot-shaped apertures separated from one another by so-called "bridges" of mask material, which tie the mask together to provide needed mechanical strength.

Figure 1:
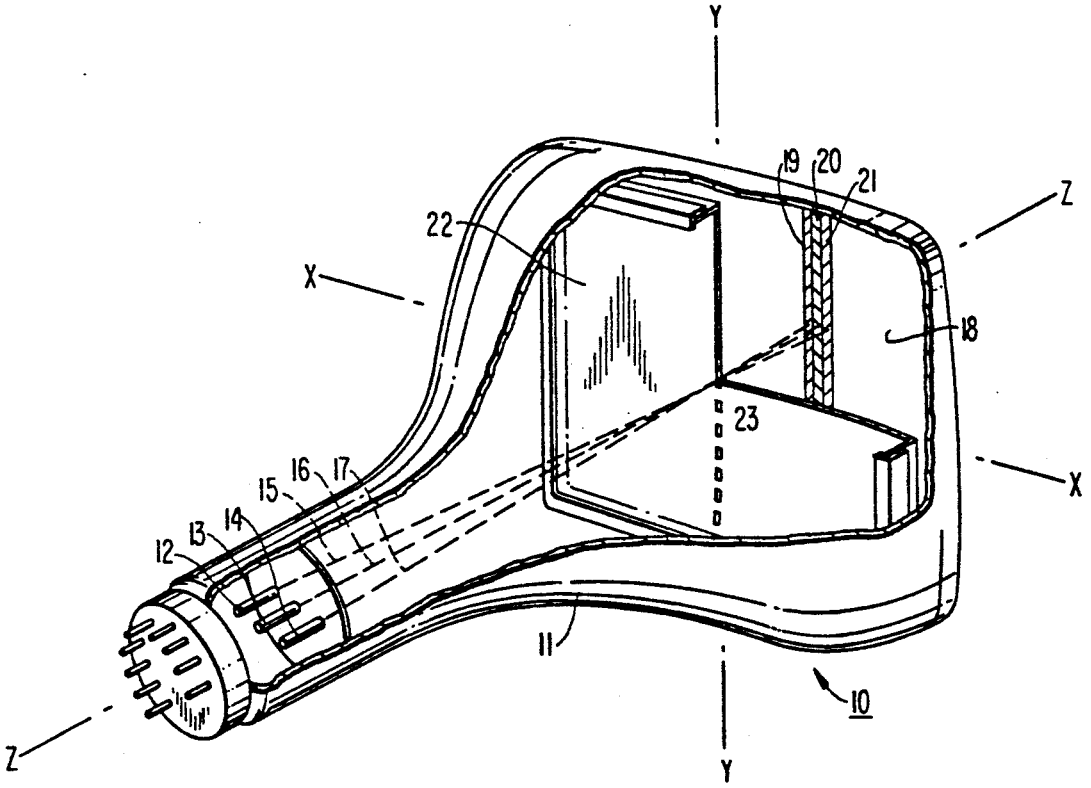
FIG. 1 PRIOR ART
FIG. 1 is a perspective view, partly cut away, of a color CRT employing a slotted aperture mask and a striped screen in accordance with the prior art.
Figure 2A:
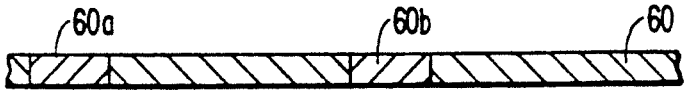
FIGS. 2(*a*) through (*l*) are diagrammatic representations of the steps of the photolithographic process used to produce color reference screens according to a preferred embodiment of the invention.
Figure 2B:
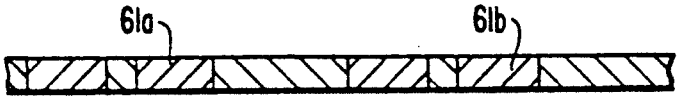
Figure 2C:
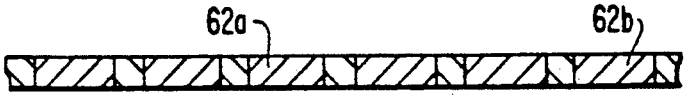
Figure 2D:
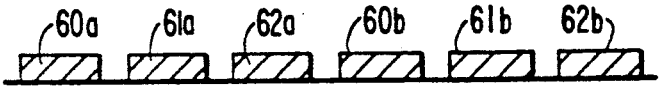
Figure 2E:
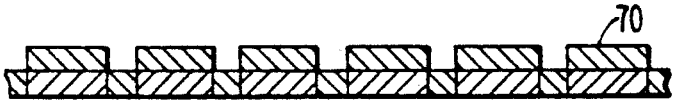
Figure 2F:
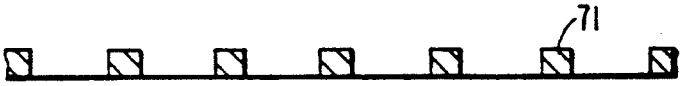
Figure 2G:
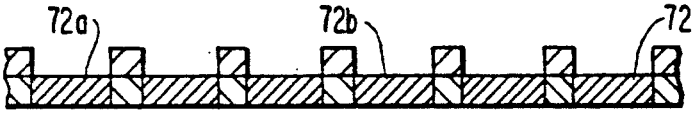
Figure 2H:
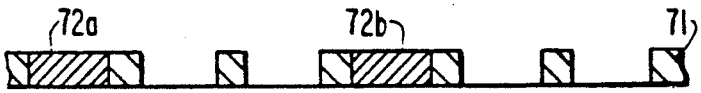
Figure 2I:
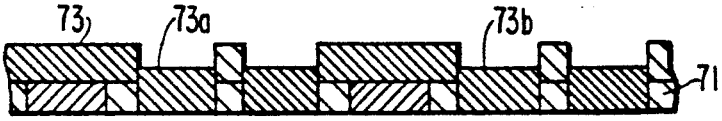
Figure 2J:
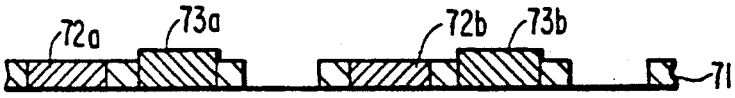
Figure 2K:
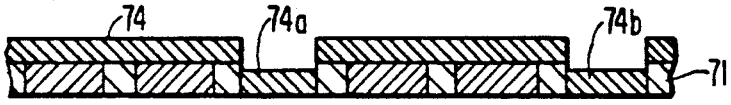
Figure 2L:
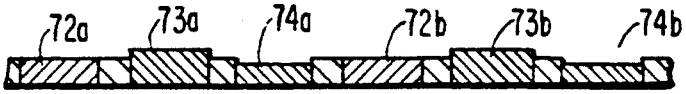

Referring now to FIG. 1, color CRT 10 is composed of evacuated glass envelope 11, electron guns 12, 13 and 14, which direct electron beams 15, 16 and 17 toward screen 18, composed of alternating red, blue and green phosphor stripes, three of which, 19, 20 and 21 are shown. The beams 15, 16 and 17 converge as they approach aperture mask 22, then pass through vertical aperture column 23 and diverge slightly to land on the appropriate phosphor stripe 19, 20 or 21. Additional columns of apertures similarly correspond to additional stripe triplets, not shown. External deflection coils and associated circuitry, not shown, cause the beams to scan the mask and screen in a known manner, to produce a rectangular raster pattern on the screen.

The stripes of screen 18 are conventionally formed photolithographically, using the aperture mask 22 as the exposure mask. In this process, an aqueous photoresist material, such as polyvinyl alcohol sensitized with a dichromate, which become insoluble in water upon exposure to a source of actinic radiation such as ultraviolet light, is exposed through the mask, and then developed by washing with water to remove the unexposed portions and leave the exposed pattern. By employing an elongated light source having a length several times that of a single aperture, the shadows cast by the bridges of mask material between the vertically adjacent apertures are almost completely eliminated, resulting in a pattern of continuous vertical stripes. In addition, by making multiple exposures, a single aperture row can result in multiple stripes. Movement of the light source to three different locations, to produce light paths corresponding to the three electron beam paths 15, 16 and 17 results in three different stripes through a single aperture row 23 in mask 22. This process is similar to that used in the production of color CRTs for color television. See, for example, U.S. Pat. Nos. 3,140,176; 3,146,368 and 4,070,596.

As is known, color screens for color CRTs can be made either with or without a light-absorbing matrix surrounding the phosphor elements. Such a matrix is generally thought to improve contrast and/or brightness of the image display. In the formation of color references in accordance with the invention, such a matrix may be advantageous in that it enables less precise control over the photolithographic process for formation of the phosphor arrays. This is because the luminance of the primary phosphor colors is controlled by adjusting the sizes of the windows in the matrix, which windows define the sizes of the phosphor elements. Window size is controlled by the dosage (intensity times time) of exposure of the photoresist used to form the matrix. In a non-matrix color reference, the luminance of the primary colors is controlled by the dosage of exposure of the photoresist used to form the phosphor array for that color.

Referring now to FIGS. 2(*a*)–2(*l*), the screen is depicted during the various steps of a preferred embodiment of the photolithographic process in which prior to the formation of the phosphor array, a light-absorbing matrix is first formed by successively exposing a single photoresist layer 60 to a source of actinic radiation from three different locations through the mask, (FIGS. 2(*a*), 2(*b*) and 2(*c*)) to result in insolubilized portions 60*a* and 60*b*, 61*a* and 61*b*, and 62*a* and 62*b*. The exposed resist is then developed to remove the unexposed portions and leave an array of photoresist elements corresponding to the contemplated phosphor pattern array (FIG. 2(*d*)). Next, a light-absorbing layer 70 is disposed over the array, (FIG. 2(*e*)), and the composite layer is developed to remove the photoresist array and overlying light-absorbing layer, leaving a matrix 71 defining an array of windows corresponding to the contemplated phosphor pattern array. (FIG. 2(*f*)). Because the exposed resist is insoluble in water, a special developer is required for this step, such as hydrogen peroxide or potassium periodate, as is known.

Next, phosphor layers are formed over the windows. The order in which the layers are formed is not critical, the order chosen here determined by the cost of the phosphor materials, the most costly materials being used last so that if the prior layer is rejected as defective, the more costly material of the subsequent layer is saved.

First, a layer of a green phosphor and photoresist 72 is disposed over the matrix layer 71 and the resultant structure (FIG. 2(*g*)), is exposed and developed to result in green elements 72*a* and 72*b* (FIG. 2(*h*)). This procedure is then repeated for the blue and red phosphors (FIG. 2(*i*) through FIG. 2 (*l*)) to result in the phosphor array having alternating green (72*a* and *b*), blue (73*a* and *b*), and red (74*a* and *b*) stripes.

As taught in U.S. Pat. No. 3,697,301, the screen brightness of a CRT is a function of its screen weight.

In accordance with the invention, the screen weights of the different phosphor layers are chosen to result in a desired reference color when the screen is scanned by an electron beam of fixed anode voltage and current. These different screen weights are represented diagrammatically in FIGS. 2(*a*)–2(*l*) as different thicknesses of layers 72, 73 and 74.

EXAMPLE

Four 27 inch color reference CRTs having screens of alternating stripes of red, blue and green-emitting phosphors were prepared. The screens were produced by a standard photolithographic technique known as the "dusting process" used for the production of color CRTs for color TV, in which each phosphor is dispensed in the dry powder state via an auger onto a wet photoresist layer on the inside of the display window, after which the layer is exposed through the aperture mask and developed, as described above with reference to FIGS. 2(*a*)–2(*l*). Only the screen weight of the green phosphor was varied, by varying the auger speed. All other parameters were kept the same.

For each tube, values were determined for: screen weight in milligrams per square centimeter; luminous output (LO) in foot lamberts, of the green component at an electron beam current of 500 microamps, and of the white field at an electron beam current of 1500 microamps; the CIE x,y color coordinates of the green and white luminous outputs; the actual white color temperature in Kelvin; and the white color temperature and the Minimum Perceptible Color Difference (MPCD) calculated from the JEDEC "Chart for Conversion of CIE Chromaticity Values to Isotemperature and MPCD Values". Results are shown below in Table I.

TABLE I

| Tube # | Auger Speed | Screen Weight | Green L.O. | Green Color x | Green Color y |
|---|---|---|---|---|---|
| 1 | 110 | 1.66 | 20.7 | .285 | .596 |
| 2 | 130 | 2.16 | 28.6 | .285 | .602 |
| 3 | 230 | 3.12 | 32.2 | .287 | .596 |
| 4 | 310 | 3.86 | 33.3 | .288 | .604 |

| Tube # | White L.O. | White Color x | White Color y | Actual Color Temp. | Calc. Color Temp | MPCD |
|---|---|---|---|---|---|---|
| 1 | 34.2 | .275 | .265 | 12200 | 11372 | −22 |
| 2 | 42.2 | .276 | .296 | 10280 | 11092 | 17 |
| 3 | 45.9 | .281 | .307 | 9400 | 9692 | 23 |
| 4 | 47.4 | .284 | .319 | 8800 | 8572 | 33 |

Figure 4:
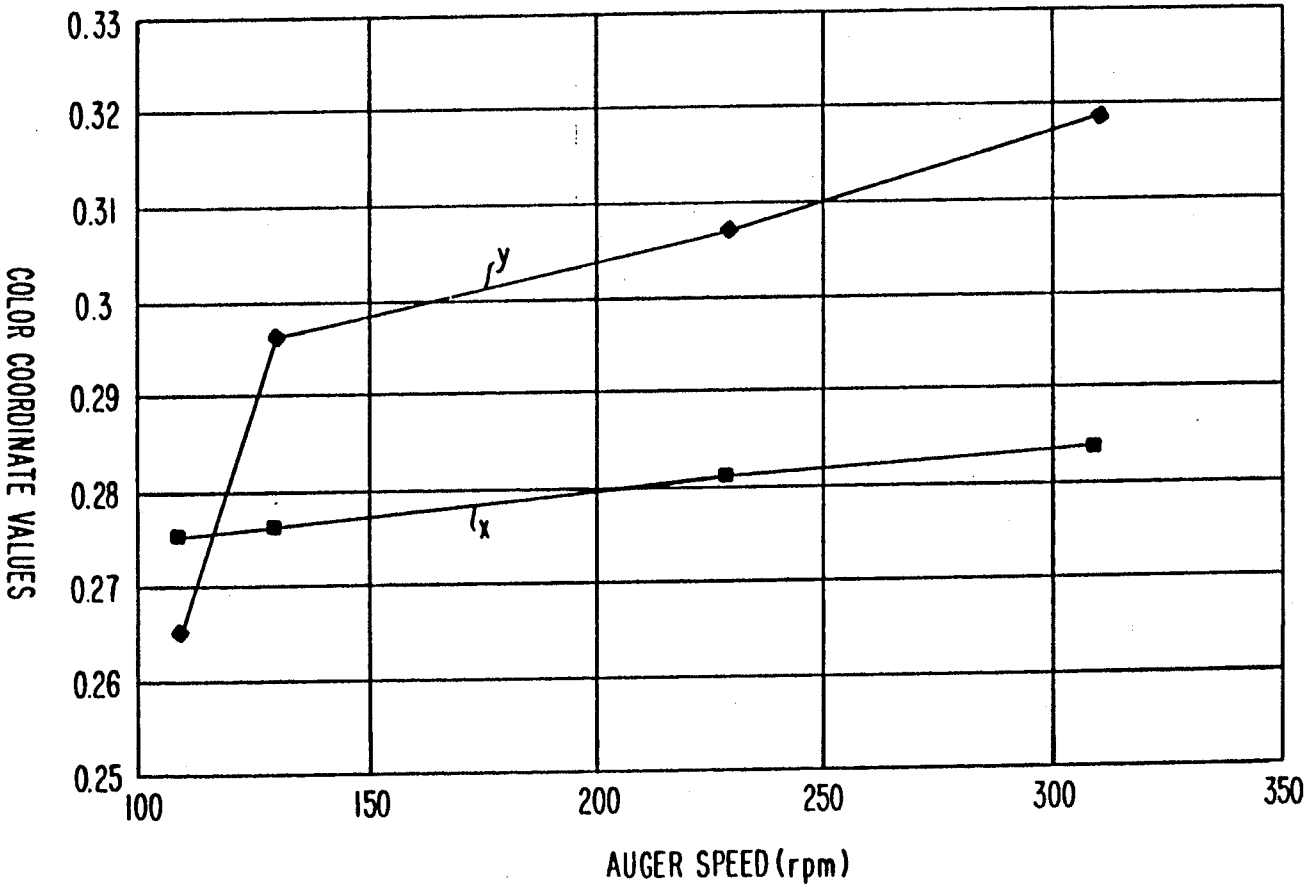
FIG. 4 is a graph showing the relationship between green auger speed in rpms and white color coordinates.

The relationship between green auger speed and white color coordinates is shown graphically in FIG. 4. The x color coordinate changes by about 0.009, while the y coordinate changes by about 0.054, as the auger speed goes from 110 to 310 revolutions per minute. Side by side plaque measurements have shown that it is possible to distinguish a 0.003 difference in color coordinates.

Figure 5:
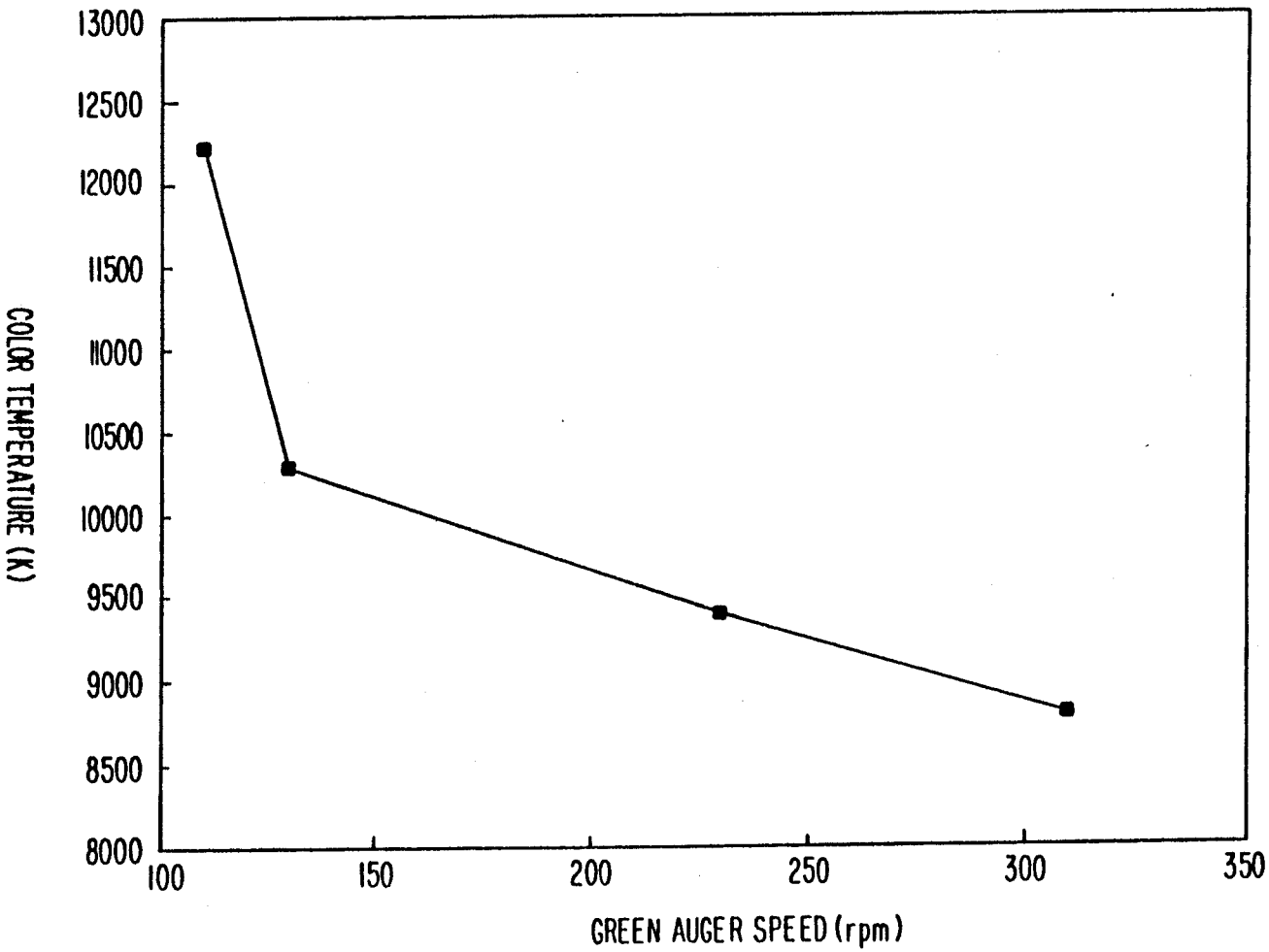
FIG. 5 is a graph showing the relationship between green auger speed in rpms and white x, y color temperature in Kelvin.

FIG. 5 shows the relationship between green auger speed and white color temperature (actual). To a first approximation, a 10 rpm increase in auger speed can give rise to a 140K reduction in white color temperature.

Figure 3:
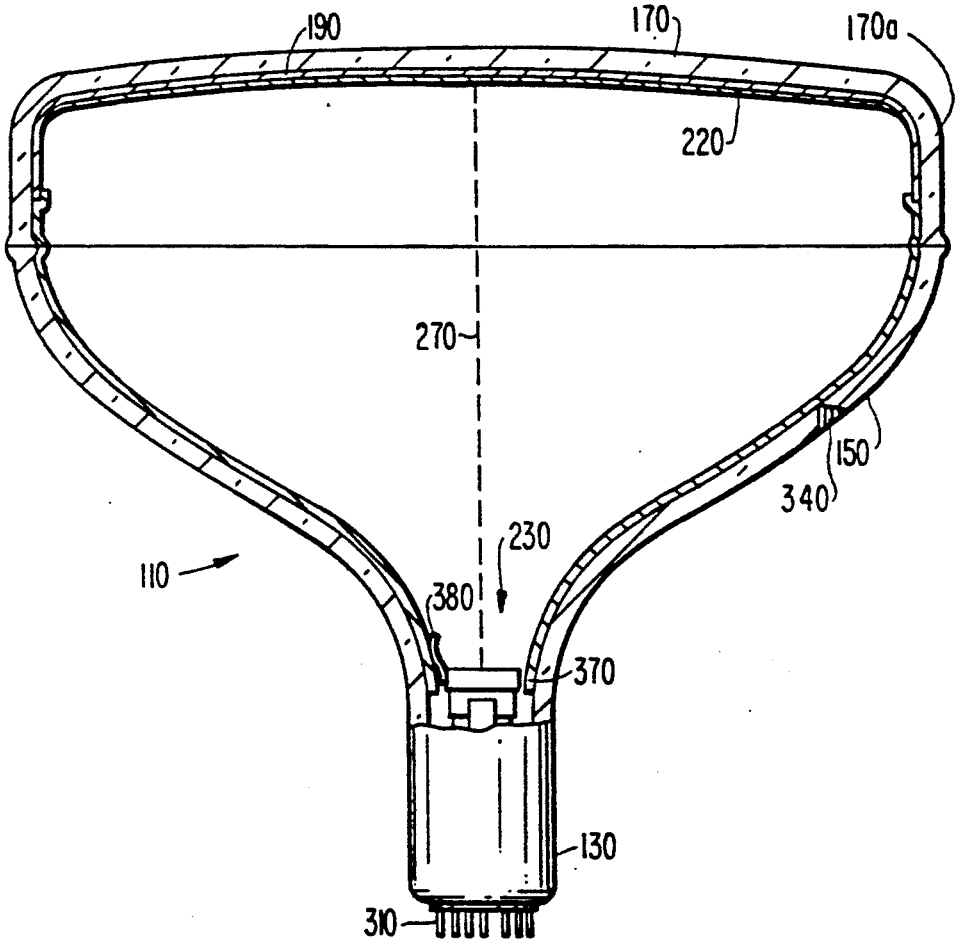
FIG. 3 is a longitudinal section view of one embodiment of a color reference CRT of the invention.

FIG. 3 is a longitudinal section view, taken through the XZ plane, of a color reference CRT of the invention. This CRT is similar to the prior art CRT of FIG. 1, except that the screen weights of the red, blue and green components of the screen 190 have been adjusted to obtain a desired reference color, the aperture mask used to form the screen has been discarded, and a single electron beam 270 emanating from gun 230 is incident on the screen.

Conductive coating 220, covering screen 190 and extending along the skirt portion 170*a* of display window 170, contacts internal coating 370 located on the inside of the funnel portion 150 and down into the neck portion 130 of envelope 110. Snubber 380 on gun 230 provides electrical contact between the gun and the screen. In operation, cathode and grid voltages are applied to the gun 230 through connector pins 310, and an anode voltage is supplied to the terminal portion of the gun and the screen through anode button 340. External deflection means, not shown, causes the beam 270 to scan the screen.

This operation is similar to that of the conventional color TV CRT of the prior art, (the internal coatings and associated connections are omitted from FIG. 1 for the sake of simplicity), except that the single beam scans all of the components of the screen at a fixed beam current, to result in a single reference color of invariant intensity and color temperature.

The invention has been described in terms of a limited number of embodiments. Other embodiments within the scope of the invention will occur to those skilled in the art. For example, it is not necessary to have only a single electron beam, so long as the beam current is invariant. Thus, a three beam color gun could also be used. In addition, a standard three-component (r,b,g) screen is not necessary. Two, four or more components may be used. The photoresist need not be polyvinyl alcohol, but could be a reciprocity law-failing resist such as a cross-linkable system of water-soluble polymers and bisazides.

The dusting technique can be varied, for example, by exposing the resist to achieve a tacky condition prior to dusting. Also, the phosphor need not be dispensed in accordance with the dusting technique described, but could, for example, be dispensed in accordance with the slurry technique, widely used in the manufacture of color TV CRTs. In such a technique, the phosphor powder is suspended in a liquid vehicle and dispensed onto the display window in this form.

In addition, the screen need not be formed photolithographically, but could also be formed, for example, by silk screening or printing. A separate exposure mask, or a separate mask for each color component, may be used, rather than the aperture mask of a color TV CRT.

What is claimed is:

1. A method for producing a color reference CRT employing a pattern of individual phosphor elements of different color components on the display window of the CRT, the method comprising adjusting the relative screen weights of the phosphors of the component color fields to achieve a desired reference color when the CRT is operated at predetermined values of beam current and anode voltage.

2. The method of claim 1 in which the screen weights are adjusted by controlling the rate at which dry phosphor powder is dispensed onto the window.

3. The method of claim 2 in which the phosphor powder is dispensed by means of an auger, and the rate is controlled by controlling the rate of rotation of the auger.

4. The method of claim 1 in which the screen weights are adjusted by controlling the amount of a slurry of the phosphor powder which is dispensed onto the window.

5. The method of claim 1 in which the pattern of phosphor elements is produced photolithographically using at least one photomask.

6. The method of claim 5 in which the photomask comprises an aperture mask of a color TV CRT.

* * * * *